US007530910B1

(12) United States Patent
Niksich et al.

(10) Patent No.: US 7,530,910 B1
(45) Date of Patent: May 12, 2009

(54) VIBRATION DAMPENING DEVICE FOR A STRUNG SPORTS RACQUET

(76) Inventors: Gene Niksich, 840 McFarland Rd., Alpharetta, GA (US) 30004; Jim Harp, 6850 Turning Leaf Ct., Cumming, GA (US) 30040

( * ) Notice: Subject to any disclaimer, the term of this patent is extended or adjusted under 35 U.S.C. 154(b) by 204 days.

(21) Appl. No.: 11/818,243

(22) Filed: Jun. 14, 2007

(51) Int. Cl.
*A63B 49/00* (2006.01)

(52) U.S. Cl. ..... 473/522

(58) Field of Classification Search ..... 473/519–522, 473/553

See application file for complete search history.

(56) References Cited

U.S. PATENT DOCUMENTS 4,761,007 A * 8/1988 Boschian ..... 473/522
4,927,143 A 5/1990 Hillock
5,022,651 A * 6/1991 Barone ..... 473/522
5,792,011 A * 8/1998 Kuebler ..... 473/520
7,014,579 B1 * 3/2006 Sung ..... 473/522
7,335,118 B1 * 2/2008 Sung ..... 473/461
7,427,245 B2 * 9/2008 Hickey ..... 473/522
2004/0023738 A1 * 2/2004 Sung ..... 473/522
2007/0265120 A1 * 11/2007 Hickey ..... 473/520
2008/0076609 A1 * 3/2008 Hickey ..... 473/522

* cited by examiner

*Primary Examiner*—Raleigh W. Chiu
(74) *Attorney, Agent, or Firm*—Norman B. Rainer

(57) ABSTRACT

A device adapted to be emplaced in a self-securing manner between adjacent strings of a tennis racquet for dampening vibrations caused by impact with a tennis ball produces beneficial sensory effects such as a whistling sound and flashing light.

10 Claims, 3 Drawing Sheets

VIBRATION DAMPENING DEVICE FOR A STRUNG SPORTS RACQUET

BACKGROUND OF THE INVENTION

1. Field of the Invention

The present invention relates to strung hand held sports racquets, and more particularly concerns devices for attachment to the strings of such racquets to attenuate vibrational effects produced by impact with a ball.

2. Discussion of the Prior Art

Most strung hand held sporting racquets have a striking surface or face formed of two intersecting sets of parallel strings suspended by and enclosed by an oval frame. One set of strings extends generally parallel to the handle of the racquet and may be called the longitudinal strings, while the other set of strings extends generally transversely of the handle and may be called the transverse or lateral strings. At their sites of intersection, the strings are interwoven in alternating over and under paths, creating an overall pattern of rectangular apertures, each aperture being defined by two adjacent longitudinal strings and two adjacent transverse strings.

In such racquets, vibrations are produced in the racquet face when a ball is struck. The vibrations are transmitted to the frame of the racquet and eventually to the hand and then the arm of the player. It has been shown that a player who has been subject to extensive periods of racquet-induced vibrations can sustain "tennis elbow" injury to his or her arm. It is therefore desirable to reduce such vibrations both for the comfort and protection of the player.

Devices for dampening the vibrations in a tennis racquet are well known. Typical devices are shown in U.S. Pat. Nos. 4,180,265; 4,609,194; 4,761,007; 4,776,590; 4,909,509; 5,022,651; 5,106,086; 5,137,769; 5,792,011; 5,871,409; 6,447,411 and 7,014,579. Devices as shown in prior patents have not been entirely successful, since they are sometimes difficult to attach to the racquet face, and can interfere with the flight of the ball if struck by the ball. Also, such devices often fall off the racquet strings during play.

U.S. Pat. No. 4,927,143 discloses a vibration dampener device having a rubbery body with a circumferential groove adapted to grip the four strings of a rectangular aperture in the striking surface. The center of the body houses a dampening fluid and interactive ball. Although useful for its intended purpose, it does not serve to enhance the proficiency of the player or the enjoyment of the game.

It is accordingly an object of the present invention to provide a vibration absorbing device for use in a strung sports racquet.

It is a further object of this invention to provide a device as in the foregoing object which is easily installed onto the strings of a racquet and durably retained therein.

It is another object of the present invention to provide a device of the aforesaid nature which produces unique action activated special effects relating to enhancement of playing interest and expertise.

These objects and other objects and advantages of the invention will be apparent from the following description.

SUMMARY OF THE INVENTION

The above and other beneficial objects and advantages are accomplished in accordance with the present invention by a device adapted to be emplaced in a self-securing manner between adjacent strings of a tennis racquet for dampening vibrations caused by impact with a tennis ball and for causing a beneficial sensory effect to be produced by the customary use of said racquet, said device comprising:

a) a monolithic anchoring base fabricated of a resilient polymer and bounded by parallel substantially flat faces spaced apart by a perimeter wall of oblong contour and a circular cylindrical bore orthogonally bridging said faces, said perimeter wall having recessed therein a continuous circumferential groove extending to a bottom that defines a square shelf configuration surrounding said bore and adapted to be embracingly contacted by said strings, b) an insert assembly comprised of inner and outer components of rigid plastic construction, each having a circular cylindrical wall bounded by internal and external surfaces and extending between an open distal extremity and a proximal extremity having an outwardly directed flange adapted to abut against a face of said base, the external surface of the wall of said outer component residing in contact with said bore, and the external surface of the wall of said inner component being in contact with the internal surface of said outer component to permit sliding telescopic interaction of said components to form a chamber region within said bore, and c) an action-activated element located within said chamber region.

In a first embodiment of the device, a piezoelectric mechanism is confined within said chamber. As an action-activated element, it emits light when said strings are impacted by a tennis ball.

In a second embodiment of the device, a conically shaped surface is associated with the proximal extremity of both components of the insert assembly, and directed toward an aperture positioned within said chamber region. Such construction represents an action-activated element. By virtue of critically dimensioned features of said conical surfaces and apertures, such second embodiment of the device, when installed into the strings of a tennis racquet, produces a whistling sound when the racquet is rapidly swung, the intensity of said sound being greater with faster swing velocities.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DETAILED DESCRIPTION OF THE PREFERRED EMBODIMENTS

Figure 1:
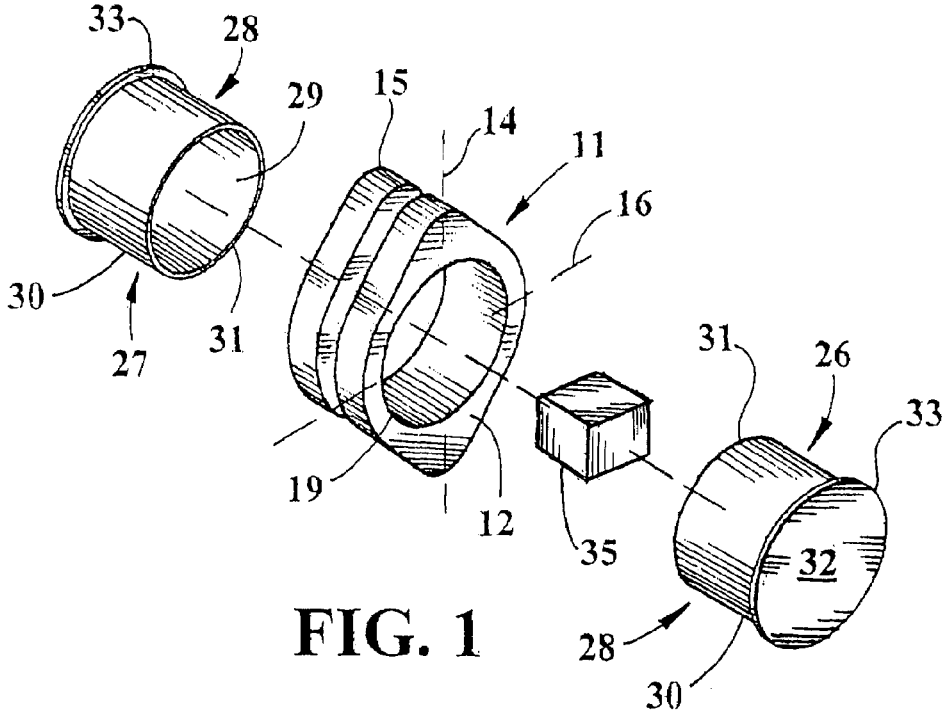
FIG. 1 is an exploded enlarged front perspective view of a first embodiment of the device of this invention.
Figure 2:
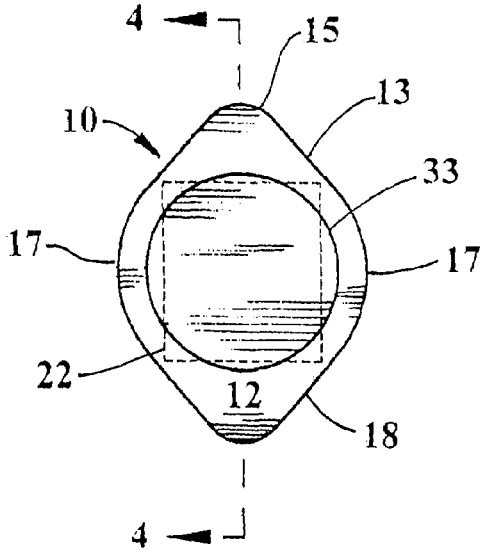
FIG. 2 is a front view of the embodiment of FIG. 1.
Figure 3:
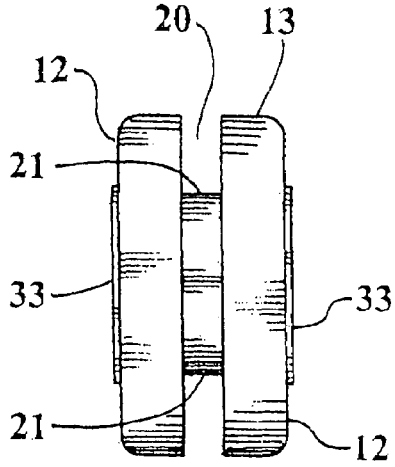
FIG. 3 is a side view of the embodiment of FIG. 2.
Figure 4:
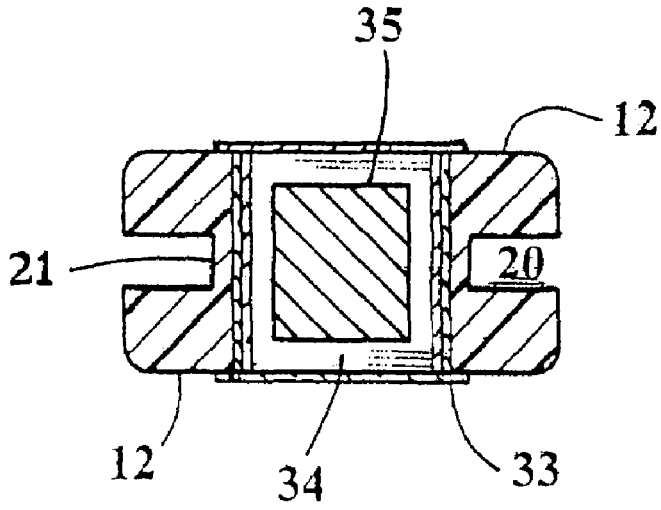
FIG. 4 is a sectional view taken in the direction of the arrows upon the line 4-4 of FIG. 2.
Figure 5:
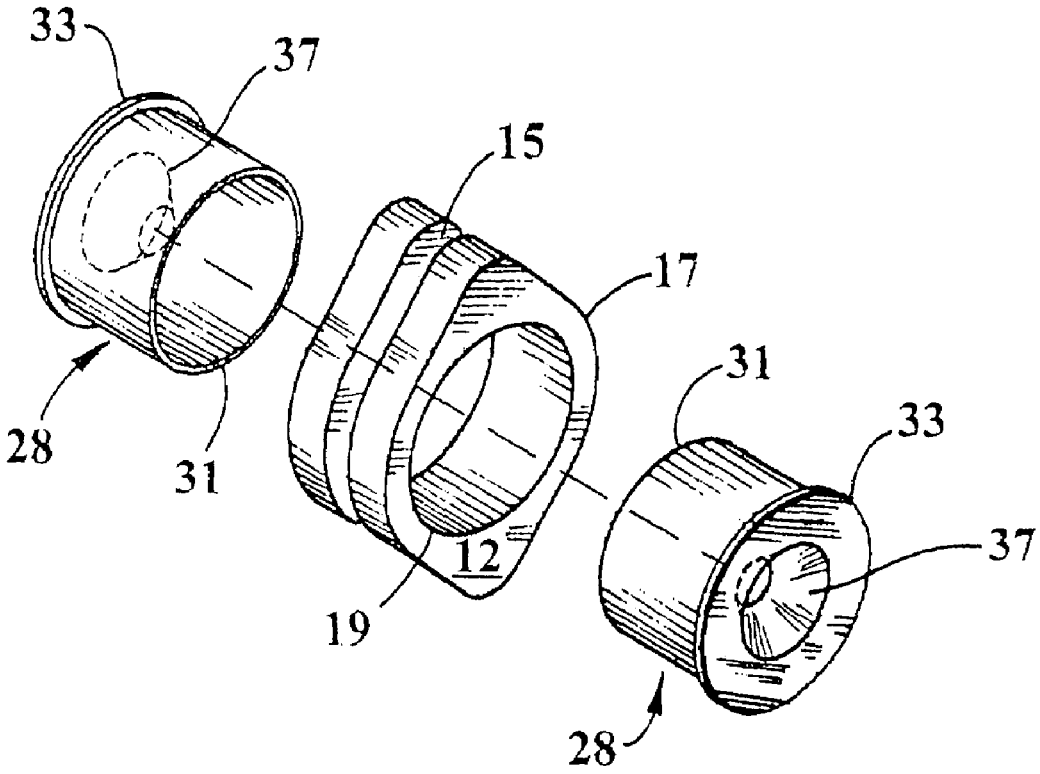
FIG. 5 is an exploded enlarged front perspective view of a second embodiment of the device of this invention.
Figure 6:
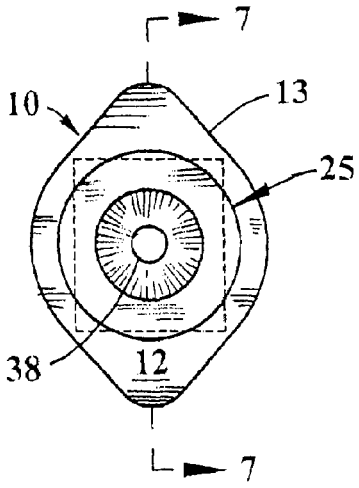
FIG. 6 is a front view of the embodiment of FIG. 5.
Figure 7:
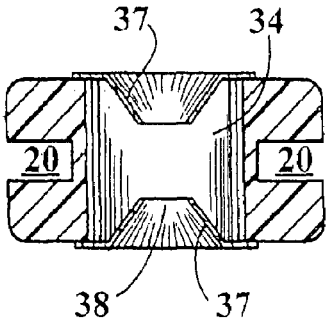
FIG. 7 is a sectional view taken in the direction of the arrows upon line 7-7 of FIG. 6.

Referring now to FIGS. 1-4, a first embodiment 10 of the invention is shown comprised of a monolithic anchoring base 11 fabricated of a resilient polymer such as plasticized polyvinyl chloride, silicone, or other moldable elastomeric composition having a Shore A Durometer Hardness in the range of 20 to 50. Said base is bounded by parallel substantially flat faces 12 spaced apart by a perimeter wall 13 which defines the thickness of the base. Said wall is of oblong contour, having a longitudinal long axis 14 which terminates in slightly rounded first apices 15, and a transverse short axis 16 that terminates in greatly rounded second apices 17. The portions 18 of perimeter wall 13 which intervene between said apices may be substantially straight, causing the base to have a substantially trapezoidal shape. A circular cylindrical bore 19 extends orthogonally between and opens upon both faces 12. Perimeter wall 13 has recessed therein a continuous circumferential groove 20 extending to a bottom 21 that defines a square shelf configuration 22 surrounding bore 19 and adapted to be embracingly contacted by the strings of the racquet. Said square configuration is oriented such that two opposed straight sides are parallel to said long axis, and the other opposed straight sides are parallel to said transverse axis.

In order to securely engage the strings of the racquet, the dimensional features of the base are of critical importance. In particular, said thickness should be about 11 millimeters. The longitudinal length should be about 24 millimeters, and the transverse length should be about 17 millimeters. The depth of groove 20, measured between its bottom 21 and perimeter wall 13, will vary along the path of the groove, but its width remains constant at about 1.6 mm.

Figure 8:
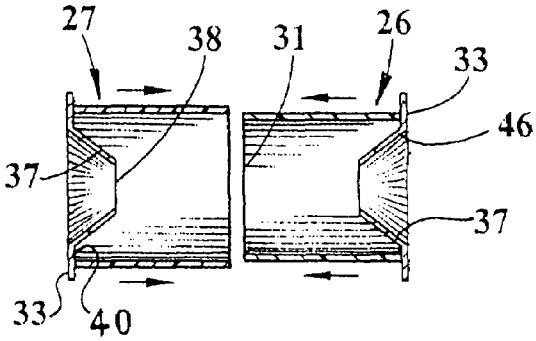
FIG. 8 is a further enlarged fragmentary sectional view of the centered components of FIG. 7 in a separated state.

An insert assembly 35 is comprised of inner and outer components 26 and 27, respectively, of rigid plastic construction. Each component is comprised of a circular cylindrical wall 28 bounded by internal and external surfaces 29 and 30, respectively. Said wall extends between an open distal extremity 31 and a proximal extremity 32 having an outwardly directed flange 33 adapted to abut against a face 12 of said base. The external surface of the wall of said outer component has a diameter of 9.5 mm, and resides in contact with bore 19. External surface 30 of the wall of inner component 26 has a diameter of 8.5 mm and resides in contact with the internal surface 29 of said outer component to permit telescopically sliding interaction between the two components, as shown by the arrowed lines in FIG. 8, to form a chamber region 34 within said bore.

In said first embodiment of the device, an action-activated element in the form of a piezoelectric mechanism 35 is confined within said chamber region. Suitable piezoelectric mechanisms are commercially available in various sizes. As an action-activated element, mechanism 35 emits flashing light when the strings are impacted by a tennis ball. Such effect adds a pleasurable element of interest to the playing of the game.

In said second embodiment of the device, as shown in FIGS. 5-8, a conical or funnel shaped nozzle surface 37 is emergent from the proximal extremity of each component of insert assembly 25, and is convergently directed toward the interior of chamber region 34. Each nozzle surface terminates in a circular aperture 38 located within chamber region 34. The apertures 38 of the nozzle surfaces of both components are in axial alignment and spaced apart by 2.5 to 3.5 mm. Such construction represents an action-activated element.

By virtue of critically dimensioned features of said nozzle surfaces and apertures, such second embodiment of the device, when installed into the strings of a tennis racquet, produces a whistling sound when the racquet is rapidly swung, the intensity of said sound being proportionately greater with faster swing velocities. In view of such functionality, the device serves as a training means to enhance the player's competence in playing the game of tennis.

In order for the aforesaid nozzle construction to produce a whistling sound, several parameters must be optimized. In particular, circular aperture 38 should have a diameter of 3.5 to 4.5 mm, and the diameter of circular entrance 46 of the nozzle surface should be between 10 and 11 mm, causing the preferred ratio of the diameter of aperture 38 to the diameter of entrance 42 to be between 0.32 and 0.45. The angle of convergence of nozzle surface 37 should be between 43 and 47 degrees, and the axial length of said nozzle surface should be between 4 and 6 mm. It is to be noted that the proximal extremity of outer component 27 contains an annular shelf region 40 which receives the distal extremity of inner component 26. This permits a close fitting complete insertion of inner assembly 26 into outer assembly 27 while enabling both nozzle surfaces to be of identical dimensions.

Figure 9:
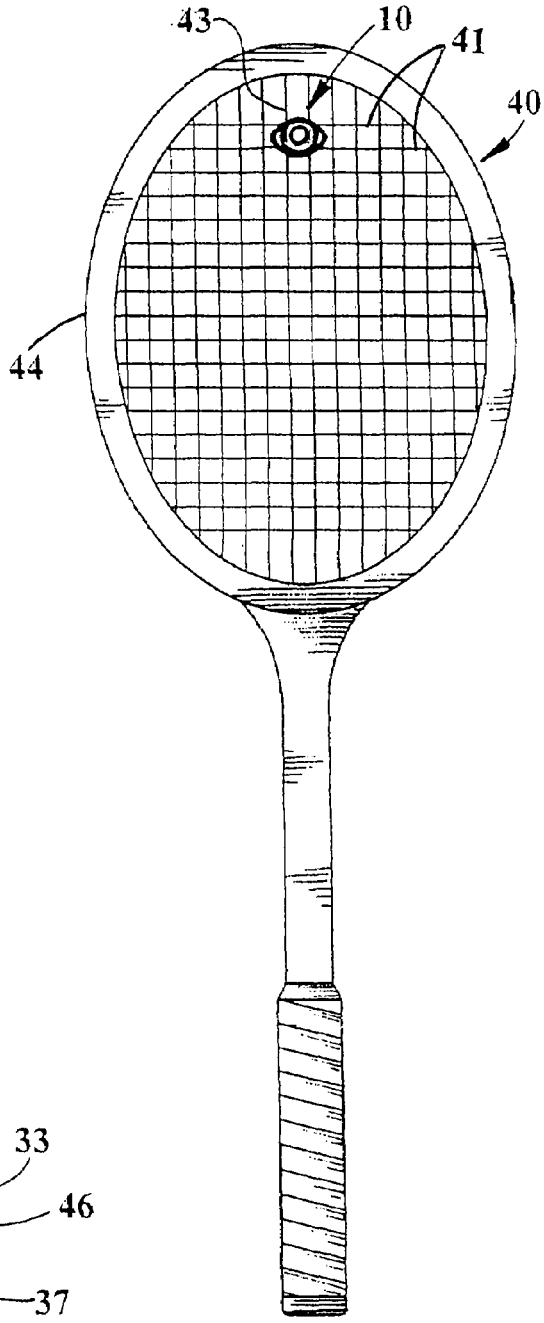
FIG. 9 is a front view of a tennis racquet having installed therein the device of this invention.

When attached to a tennis racquet 40, as shown in FIG. 9, the device of this invention is preferably caused to engage a rectangular aperture in the racquet face formed by two center strings 43 and two uppermost transverse strings 41 adjacent the frame 44. The device is inserted into said aperture with the longitudinal axis of the device initially oriented with the longitudinal strings, then twisted a quarter turn so that said longitudinal axis becomes aligned with said transverse strings. Such action locks the device in place because the four strings comprising said rectangular aperture enter groove 20 and abut against the bottom 21 of square shelf 22. Certain modifications of the device of this invention may also be usefully attached to the extremities of other sporting equipment, such as baseball bats and golf clubs, where high velocity swinging motion and impact with a ball are involved.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described our invention, what is claimed is:

1. A device adapted to be emplaced in a self-securing manner between adjacent strings of a tennis racquet for dampening vibrations caused by impact with a tennis ball and for causing a beneficial sensory effect to be produced by the customary use of said racquet, said device comprising:

a) a monolithic anchoring base fabricated of a resilient polymer and bounded by parallel substantially flat faces spaced apart by a perimeter wall of oblong contour and a circular cylindrical bore orthogonally bridging said faces, said perimeter wall having recessed therein a continuous circumferential groove extending to a bottom that defines a square shelf configuration surrounding said bore and adapted to be embracingly contacted by said strings, b) an insert assembly comprised of inner and outer components of rigid plastic construction, each having a circular cylindrical wall bounded by internal and external surfaces and extending between an open distal extremity and a proximal extremity having an outwardly directed flange adapted to abut against a face of said base, the external surface of the wall of said outer component residing in contact with said bore, and the external surface of the wall of said inner component being in contact with the internal surface of said outer component to permit sliding telescopic interaction of said components to form a chamber region within said bore, and c) an action-activated element located within said chamber region.

2. The device of claim 1 wherein said action-activated element is a piezoelectric mechanism which emits light when said strings are impacted by a tennis ball.

3. The device of claim 1 wherein said action-activated element is a noise-producing mechanism comprised of a conically shaped surface associated with the proximal extremity of each component of said insert assembly and convergently directed toward an aperture positioned within said chamber region, said mechanism producing, when installed into the strings of a tennis racquet, a whistling sound when the racquet is rapidly swung, the intensity of said sound being greater with faster swing velocities.

4. The device of claim 3 wherein the apertures of said conically shaped surfaces are spaced apart within said chamber region by a distance between 2.5 and 3.5 millimeters.

5. The device of claim 4 wherein said apertures have identical circular diameters in the range of 3.5 to 4.5 millimeters.

6. The device of claim 5 wherein said conically shaped surface has an angle of convergence between 43 and 47 degrees, and has an axial length between 4 and 6 millimeters.

7. The device of claim 1 wherein said resilient polymer has a Shore Durometer Hardness in the range of 20 to 50.

8. The device of claim 1 wherein said perimeter wall is of oblong contour, having a long axis which terminates in slightly rounded first apices, and a transverse short axis that terminates in second apices which are more rounded than said first apices.

9. The device of claim 8 wherein portions of said perimeter wall which extend between said apices are straight.

10. The device of claim 8 wherein said square configuration is oriented such that two opposed straight sides are parallel to said long axis, and the other two opposed straight sides are parallel to said transverse axis.

* * * * *